United States Patent [19]

Helffrich

[11] 4,213,008

[45] Jul. 15, 1980

[54] LOUDSPEAKER ENCLOSURE FOR MID-WALL LOCATION

[76] Inventor: Edmund R. Helffrich, 3802 Turner St., Allentown, Pa. 18104

[21] Appl. No.: 963,068

[22] Filed: Nov. 22, 1978

[51] Int. Cl.[2] ..... H04R 1/30

[52] U.S. Cl. ..... 179/1 E; 179/146 E; 181/145; 181/152; 181/153

[58] Field of Search ..... 179/1 E, 115.5 H, 116, 179/146 E; 181/144, 145, 146, 147, 148, 149, 150, 151, 152, 153, 154, 155, 156

[56] References Cited

U.S. PATENT DOCUMENTS

| | | | |
|---|---|---|---|
| 2,969,848 | 1/1961 | Farwell | 181/145 |
| 3,898,384 | 8/1975 | Goeckel | 179/1 E |

*Primary Examiner*—James W. Moffitt
*Attorney, Agent, or Firm*—Dowell and Dowell

[57] ABSTRACT

A loudspeaker enclosure comprising a cabinet to be located adjacent to a wall and having a horn contained therein driven by two loudspeakers oriented at right angles to the axis of the throat portion of the horn in which they are located and on opposite sides thereof, the speakers being substantially aligned in close mutual proximity and driven out-of-phase to provide adequate drive to the horn while tending to damp each other's excursions, and the horn having an internal expansion air column which extends into an external expansion air column bounded by the cabinet and by the wall and floor of the room, the external air column having a catenoidal rate of expansion which terminates in very rapid flaring closely matching the high expansion rate of the air column into the room which results from placing the horn at a mid-wall location, as distinguished from a corner-wall location.

10 Claims, 4 Drawing Figures

LOUDSPEAKER ENCLOSURE FOR MID-WALL LOCATION

FIELD OF INVENTION

This invention relates to improved loudspeaker enclosures of the type which use the wall and floor surfaces of a room as part of the expansion air column, and more particularly relates to an expansion rate which makes the enclosure suitable for a mid-wall location, meaning some location along a wall other than a corner location, the present enclosure having a cooperative dual speaker drive system.

BACKGROUND AND PRIOR ART

It has long been recognized in the prior art that the walls and floor and ceiling of a room form part of the air column for a loudspeaker enclosure and must cooperate therewith. The prior art has provided a number of corner horns which seek this type of cooperation, and which use the two walls and the floor which meet in the corner of the room as an extension of the speaker enclosure air column. Examples of this type of loudspeaker system are included in U.S Pat No. 2,310,243 to Klipsch, in U.S. Pat. No. 2,825,419 to Stephens and in U.S. Pat. No. 2,815,086 to Hartsfield. These speaker enclosures seek to match the expansion beginning in the corner of a room, which expansion can be thought of as extending through one-eighth of a sphere. The ideal speaker enclosure for driving this one-eighth spherical air column would be an enclosure whose horn feeds smoothly thereinto without discontinuities attributable to a sudden change in the expansion rate at the mouth of the horn. The expansion rate known in the prior art is occasionally hyperbolic, but it is usually exponential so that the volume of air in the horn doubles for each unit length thereof commencing at the origin, the rate of expansion having been figured out essentially empirically to provide a family of horns whose cutoff frequency at the lower end of their response curve is determined by the selected expansion rate. These figures are well tabulated, an example of such tabulation appearing in the text "How to Build Speaker Enclosures" by Alexis Badmaieff and Don Davis, Howard W. Sams and Company, Indianapolis, Indiana, 13th printing (1978) at pages 86 and 87.

The present invention relates to a horn system having an expansion rate which becomes catenary between the cabinet and the wall. Although the above publication at page 12 mentions catenary expansion and at page 86 refers to a "Lee Catenary Horn", this is the only reference of which the applicant is presently aware which mentions a catenary expansion for a horn. No further description or specification of the "Lee Catenary Horn" has been found.

One serious disadvantage of a corner horn structure of the type set forth in the three above mentioned patents is that it is essentially unsuitable for stereo reproduction which requires two such cabinets. The corners of a room are generally too far apart for the placement of the two stereo speaker units, which should be placed some six or eight feet apart rather than the full length or width of a room. The corner horn cannot be moved to a more mid-wall location without spoiling its coupling to the air in the room. The present invention seeks to solve this problem by providing a type of cabinet which can be mounted to a mid-wall position so that two such cabinets can be spaced apart on the same wall by the distance required for optimum stereophonic reproduction.

One difficulty encountered in designing a horn for mid-wall location is that it must achieve a much higher expansion rate than a corner horn cabinet because it must drive an air volume in the room which volume is a quarter of a sphere, rather than driving a corner air volume which is one-eighth of a sphere. In attempting to design a horn for mid-wall mounting, it turns out that a cabinet housing a horn which continues an exponential expansion into the room would have to be very large because it would have to fold a long horn many times within the cabinet length. For instance, a horn seeking to maintain an exponential expansion which is good to thirty Hz before cutoff would have to be about sixteen feet long, and this would require many foldings of the horn within the cabinet, these foldings generally being at angles much greater than ninety degrees since the horn usually folds back and forth within the cabinet. Each time that a horn is folded, the fold introduces unpredictable discontinuities since the path length around the fold is quite variable from one side of the horn to the other. This introduces different phase velocities at different frequencies which creates a distortion of the sound coming from the mouth of the speaker. Moreover, folds of the horn exceeding ninety degrees encourage internal reflections of the sound waves inside the horn, thereby causing non-linearities in the performance of the horn at different frequencies. Many of the folded exponential horns have low pass filters located in the vicinity of the speaker for the purpose of restricting the throat area and preventing the mid-range frequencies from entering the horn since these frequencies are more subject to phase distortion than the lower frequencies which the horn is designed to pass with efficiency. Nevertheless, such distortions still result. Moreover, a horn of such length is much more expensive to build and requires an excessively large cabinet, which is undesirable in stereo systems where two cabinets are usually necessary on the same wall.

THE INVENTION

This invention provides an air column enclosure and loudspeaker driving system for the air column which is suitable for mid-wall positioning and which has a much higher rate of expansion beyond the mouth of the cabinet so that the final bell portion of the horn flares rapidly enough to match the characteristic of the room using the airspace between the wall and the floor and the cabinet itself to match a one-quarter spherical air column, rather than a one-eighth spherical air column which must be matched by a corner horn of the type discussed earlier in this specification. For this purpose, the disclosure teaches the use of catenoidal expansion beyond the mouth of the horn using the floor and the exterior cabinet surfaces. The bell at the end of the air column is made to expand much more rapidly by following a catenoidal curve than would be possible by following an exponential expansion rate. The horn inside of the cabinet can be made relatively short so that it is not necessary to fold it back and forth multiple times within the cabinet. The present disclosure teaches a cabinet whose horn is angled only once, and then at an approximate right angle, rather than folding it back and forth upon itself as would be necessary in the case of a longer air column horn. The exterior surfaces of the cabinet and its cooperation with the wall and floor provide the catenoidal bell portion of the horn used for matching the one-quarter spherical air column of the room which extends outwardly from the wall and floor, the match being achieved with good accuracy so that there are no serious discontinuities in the over-all air column.

In addition, the present invention teaches an improved loudspeaker driver system in which two loudspeakers have their axes extending transversely across the throat of the horn, one speaker being mounted on one side of the horn and facing forwardly into the room to also provide mid-range radiation, and the other speaker being totally enclosed and extending into the horn from the other side of its throat substantially in axial alignment with the first speaker. These two speakers are driven out-of-phase so that their diaphragms provide a dual piston effect which is cumulative within the throat of the horn, either reducing or increasing the volume of air in the horn as the speakers are driven out-of-phase. The rear speaker does not radiate into the room except through the horn. However, the action of its cone directly opposes the action of the cone of the front speaker which does radiate mid-range frequencies into the room. Thus, the excursion of each speaker is opposed by the excursion of the other speaker whereby the amplitudes of both excursions are greatly reduced. Since the amplitudes of the low frequency excursions are reduced, the mid-range Doppler distortions of the front speaker as it radiates mid-range frequencies directly into the room is greatly reduced. This reduction occurs because the low frequency excursions of the cone are cut about in half and are strongly damped by the excursions of the second speaker in the rear of the horn. As a result, excessive excursions of the forward speaker cone are avoided, and it would be these excessive excursions which would contribute most heavily to Doppler distortions of the higher frequency components. Looked at in another way, for a given throat volume, when two speakers are driven out-of-phase with each other so as to provide opposing cone motions inside the throat, each speaker must in effect drive only half the throat volume that a single speaker would drive, and therefore the two speakers together provide as much drive as a single speaker while at the same time damping spurious motions. The most undesirable motions of the cones result from excursions of the cone attributable to less than perfect coupling of the cone to the air column, i.e. at the lowest response of frequencies.

It is a principal object of this invention to provide an improved loudspeaker enclosure having an air column which flares sufficiently rapidly at its final bell portion that the column can be smoothly coupled to the air within the room when the cabinet is mounted at a mid-wall position as distinguished from a corner-wall position.

It is another major object of this invention to provide a speaker system in which a short horn portion located within the cabinet is driven by a pair of loudspeakers which together provide about as much drive as a single loudspeaker would provide to the horn, while at the same time each speaker opposes the motion of the cone of the other speaker within the horn, thereby damping any cone motions which might become excessive and/or which might not accurately follow the electrical signals driving the speakers.

Another object of the invention is to provide a loudspeaker system in which the air column of the horn extends from the speakers vertically downwardly within the cabinet and then bends rearwardly and extends at about right angles through the rear of the cabinet near its bottom. The right angle bend near the mouth of the column provides a graduation of path lengths for higher frequencies, but provides a more nearly constant path length for the lower frequencies. As a result, the lower frequencies tend to come out of the mouth at the rear of the cabinet in a frontal wave which impinges as a vertical wave front against the wall, whereas the higher frequencies tend to come out of the mouth of the speaker in a frontal wave pattern which is canted at a steep angle to the vertical and which tends to strike the wall with a more edgewise orientation so that its reflection from the wall as a frontal wave is discouraged. This construction plus the clean mid-range response of the horn, quite free of Doppler distortion, make it possible to omit using a low-pass filter in the form of an inductance in the electrical dividing network which is usually used to limit the higher frequencies fed to the bass speaker which is commonly used in prior art enclosures, thereby eliminating phase delay distortions introduced by such a low-pass filter. The suppression of spurious phase distortions is most important in a stereophonic speaker system.

Another object of the invention is to eliminate the acoustical type low-pass filter in the form of a restriction past the chamber housing the rear of the speaker as is commonly used in prior art horn-type enclosures. The intention of these acoustical type low-pass filters is to limit the area of the cross section of the throat of the horn, but these filters also have the effect of introducing phase delay distortions. The type low-pass filter used in prior art construction has been eliminated by the method of mounting the speakers driving the horn transversely across the horn in the present invention.

Another object of the invention is to provide a horn having a catenoidal expansion into the room which provides the rapid flare needed to couple with the air in the room using a short horn, because the cross section of the horn doubles at increasingly small axial increments along the axis of the horn. Moreover, the volume of air contained in each successively doubled cross section tends to remain essentially the same so that the expanding wave encounters an almost constant weight of air to push ahead of it with each successive doubling of the cross section of the horn. The exponential expansion does not provide this feature, because each time the cross sectional volume of the exponential horn doubles, the volume of air within that section increases at an increasing rate so that a sound wave is encountering increasing impedance to movement of the air volume. Because of this peculiar relationship between the doubling of the cross section of a catenary bell flare and the relatively constant air volume within each such cross section, there is no place in the catenary where the waves passing through the bell encounter a mass of air which suddenly increases, and therefore there is less likelihood of reflection of energy back into the horn. This is a characteristic which has a counterpart in the design of brass instruments. For instance, the bell on a French horn is essentially catenoidal, and therefore the musician must place his hand over the bell in order to create reflections back into the horn to more easily sustain the standing waves. Conversely, the bell on a trombone is essentially exponential, and therefore there is a discontinuity at the mouth thereof which causes sufficient reflections back into the trombone to sustain its vibrating air column. However, in loudspeaker enclosure systems, reflections from discontinuities near the bell of the air column are highly undesirable, and it was this fact which made the use of a catenoidal expansion attractive for providing an improved loudspeaker air column bell having minimal reflective discontinuity.

It is a further object of the invention to provide a dual speaker drive for the throat of the horn arranged transversely across the throat so that the throat can be made narrower while at the same time providing a large cone area driving the throat. Narrowing the throat tends to increase the efficiency of the horn, which is generally recognized as being a function of the ratio of the area of the mouth of the horn to the area of the throat of the horn. By using dual speakers mounted transversely across the horn it is possible to make the throat of the horn smaller to increase its efficiency in this manner rather than by enlarging the mouth, since it is not desirable for practical reasons to make the mouth of the horn larger in the present device. It is thought to be desirable to make the cabinet as small as possible where two such cabinets are needed for stereophonic reproduction.

Another object of the invention is to provide a dual loudspeaker driver system in which the front speaker radiates mid-range frequencies into the room directly, and both the front and the back speakers radiate low frequencies into the horn, and in which the two speakers are driven 180° out-of-phase electrically so that the rear speaker has the effect of reducing the excursion of the cone of the front speaker while providing drive to the horn which is in phase with the drive to the horn provided by the front speaker. This system provides an excellent response over the low and mid-range frequencies so that the inductance which is usually used in a frequency dividing network driving a woofer speaker can be eliminated. The reduction of the amplitude of excursion of the front loudspeaker makes the higher frequencies radiated by the front loudspeaker directly into the room sufficiently clean and free of distortion of the Doppler type that it is unnecessary to use a frequency dividing network to remove the mid-range frequencies from the horn driving speakers. The inductances in such networks themselves introduce a degree of phase distortion at various frequencies, and therefore the elimination of inductances tends to reduce overall distortion in the system. The portion of the horn on which the rear loudspeaker is mounted has been canted at an angle to the portion of the horn on which the forward loudspeaker is mounted. This tends to eliminate standing waves between the speakers and also between opposing surfaces within the portion of the horn through which these two speakers extend, these surfaces being likewise canted somewhat out of parallel mutual relationship.

Other objects and advantages of the invention will become apparent during the following discussion of the drawings.

THE DRAWINGS

Figure 1:
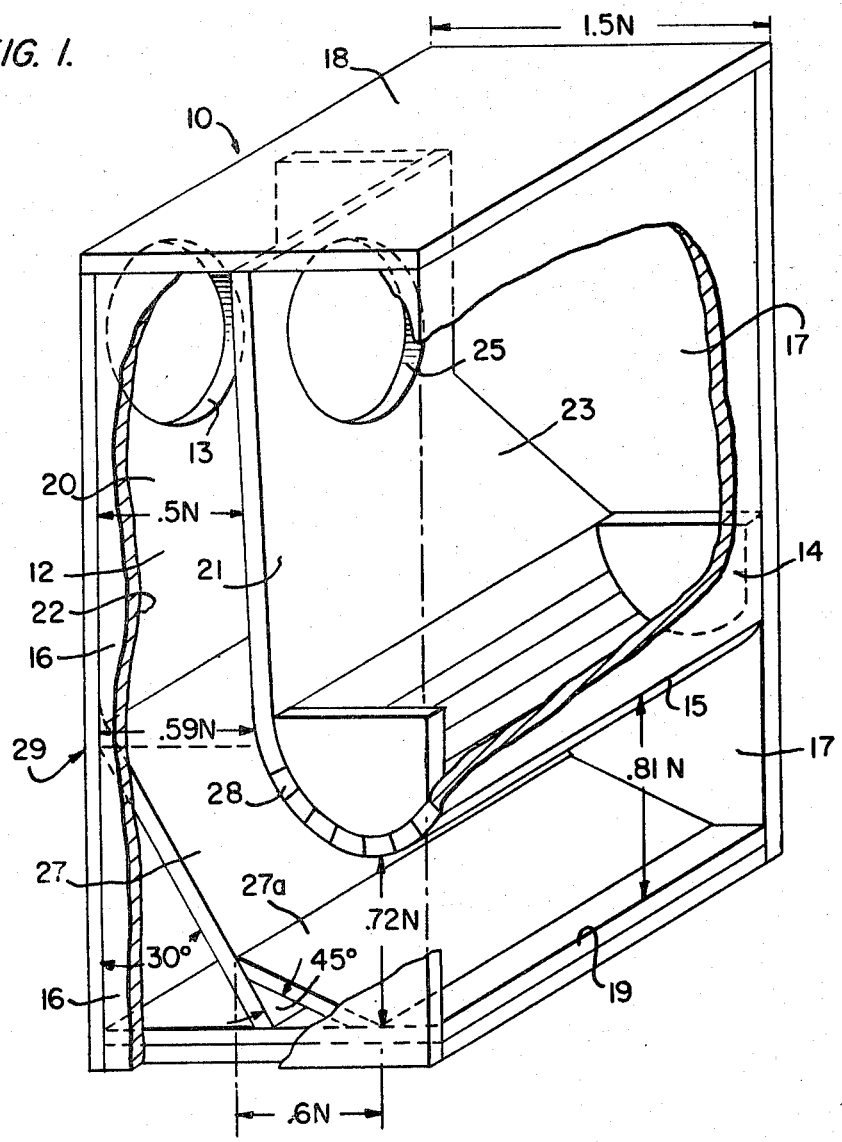
FIG. 1 is a perspective view showing a loudspeaker enclosure according to the present invention with its cabinet partly broken away to show the internal construction.

Referring now to FIG. 1 the exterior of the loudspeaker enclosure is essentially rectangular. The cabinet 10 includes a front panel 12, a rear panel 14, side panels 16 and 17, a top panel 18 and a bottom panel 19. Inside the cabinet there is a horn having two portions.

Figure 3:
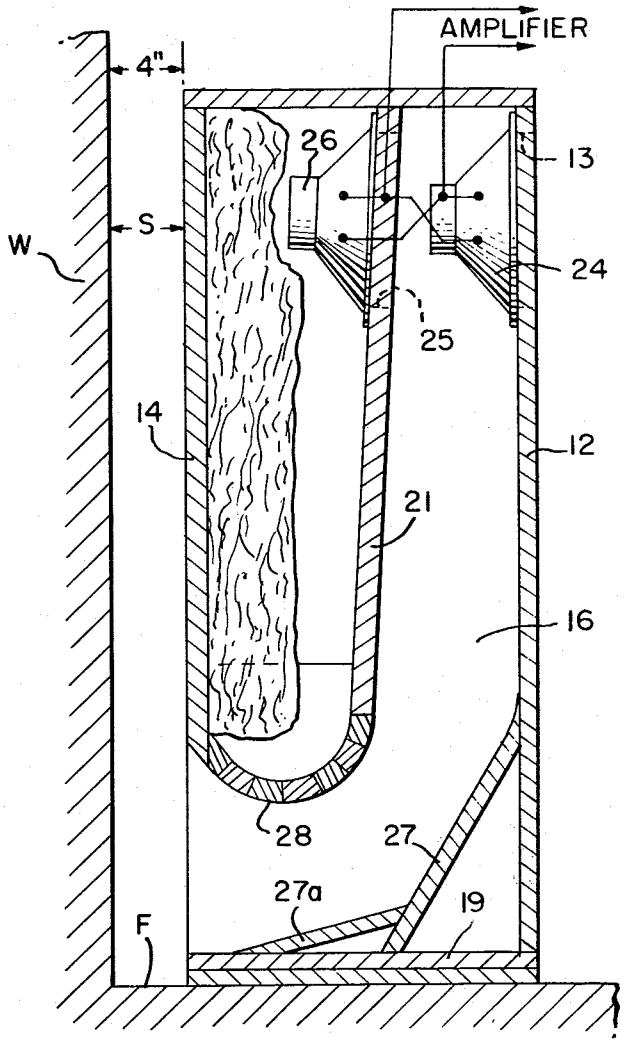
FIG. 3 is a cross sectional view taken along line 3—3 of FIG. 2 and showing the cabinet placed on the floor and spaced from a wall.

The first horn portion is essentially conical and includes a front wall portion 20, a rear wall portion 21, and side walls 22 and 23, the side wall 22 comprising a portion of the side panel 16 of the cabinet. The front panel 12 has a hole 13 extending therethrough designed to receive a loudspeaker 24 as can be seen in FIG. 3. Likewise, the rear wall 21 of the horn has an opening 25 designed to receive a second loudspeaker 26, both speakers facing forwardly toward the room. This first horn portion corresponds with the curve T to B in FIG. 4.

Figure 2:
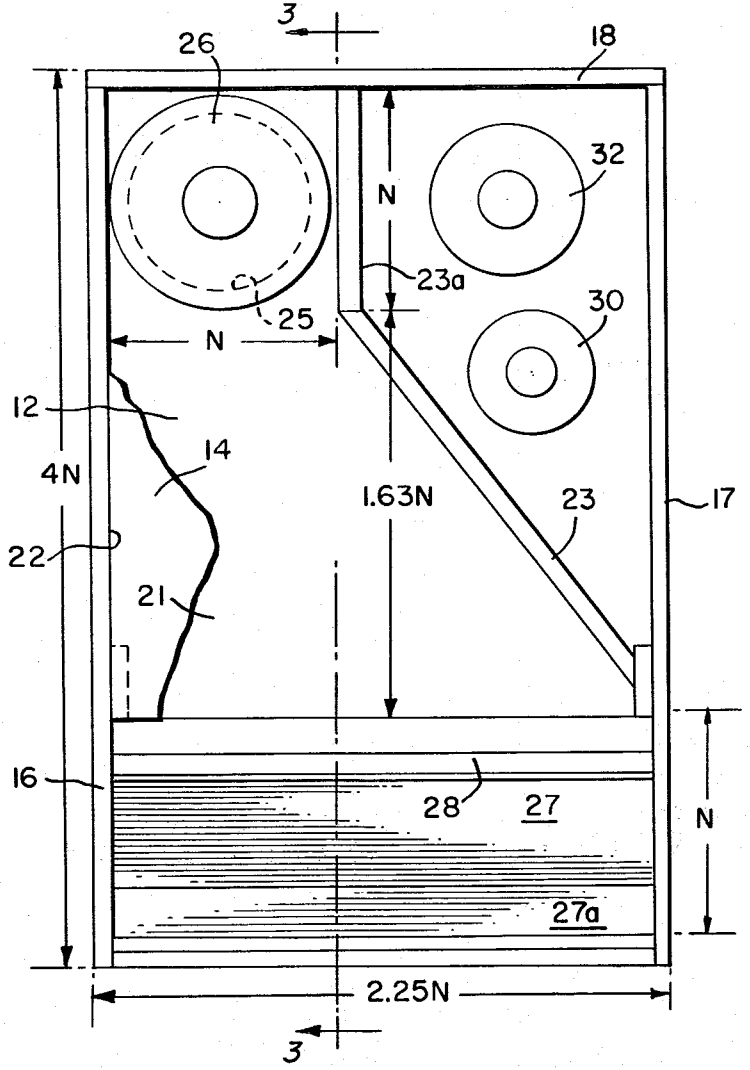
FIG. 2 is a rear view with the rear panel removed and showing the construction inside of the cabinet.

The second portion of the horn has an exponential rate of expansion as can be seen in FIGS. 1 and 2. This second portion is formed by two wall portions including the front curved wall 27 and **27*a* and the rear curved wall 28. The second wall portion corresponds with curve B to M in FIG. 4. The wall portion 28 is made of a number of slats of wood which are shaped to provide the surfaces as can be seen best in FIGS. 1 and 3. The use of slats of this sort is of course well-known in the loudspeaker cabinet art for producing curved horn surfaces, and this technique can be used to make a more smoothly curved front wall 27-27*a* if desired. The exponential portion of the horn begins at the level marked 29 in FIG. 1 and extends to the mouth at the rear of the cabinet which is bounded by the two side walls 16 and 17, and by the rear edge of the bottom panel 19 of the cabinet and by the bottom edge 15 of the rear panel 14** of the cabinet. It should be noted that this type of construction permits a horn to be made which has only a single folded portion, and does not require a larger number of horn portions which must be folded back and forth on each other at acute angles, whereby the present structure greatly reduces amplitude distortion of the various frequencies of the waves leaving the cabinet, as has been previously discussed in this specification.

Figure 4:
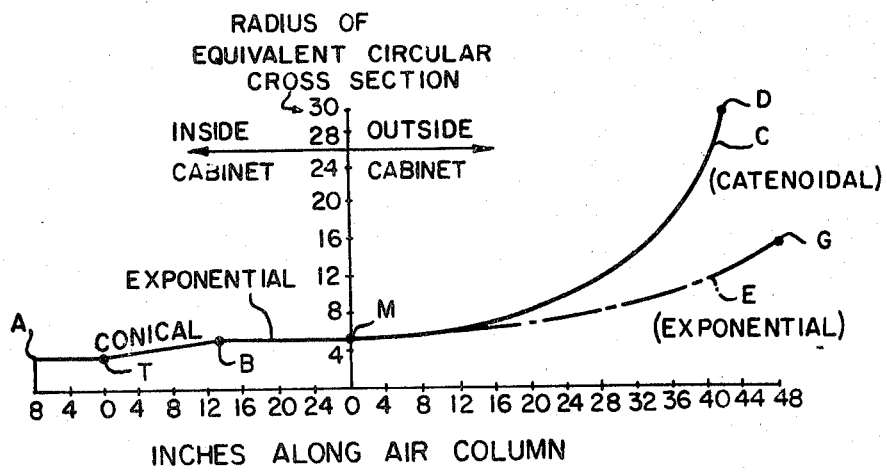
FIG. 4 is a graphical illustration of the expansion contour of the present air column as compared with a horn having an exponential expansion at its bell.

Referring now to FIG. 4 of the drawing this figure shows a graphical representation of the difference between a catenoidal expansion and an exponential expansion beyond the mouth M of a cabinet. If a room is considered as having a radiation source comprising a point source at the place where a side wall W meets the floor F of the room as shown in FIG. 3, then sound expands from that radiation point in a path corresponding with one-quarter of a sphere since the spherical expansion is bounded on the one hand by the floor and on the other hand by the vertical wall W extending above the point. The present problem is to approximate such spherical expansion as nearly as possible at the bell of the air column using the outer contour of the loudspeaker cabinet together with the wall so that the rate of expansion of the sound waves leaving the cabinet matches the spherical expansion which the waves will experience in the room as nearly as possible. As can be seen by looking at the dot-dash curve E marked exponential in FIG. 4, the expansion rate between M and G is quite slow, so that when sound waves pass from an exponential horn into the room, their rate of expansion is also slow. Such a slow rate is more suitable for one of the corner horns described in the prior art mentioned above where the expansion in the room is one-eighth spherical.

On the other hand, by looking at the portion C of the curve marked catenoidal which extends from the mouth M to the end of the bell at point D, it will be noted that the final portion of the curve is approaching the vertical quite rapidly, and therefore more closely matches the very rapid rate of expansion which will be experienced by the waves as they enter the room beyond the cabinet when leaving the expansion zone bounded by the exterior panel surfaces of the cabinet and by the wall and floor of the room. The reason that the catenoidal curve C is more desirable than the exponential curve E is that it achieves this high rate of expansion much more rapidly. This in turn permits a cabinet to be made wherein a smooth expansion is obtained without the necessity of folding a great length of horn back and forth inside the cabinet. The folding of a long horn, where the angle of each fold is much more than 90 degrees tends to create distortion due to the formation of standing waves within the horn. These standing waves will tend to make certain notes, where the wave length of the note is a multiple of the distance between two panels, be louder than they should be. This condition is referred to in the art as a "non-linear frequency response", and it is an object of this invention to eliminate this sort of distortion from these causes.

Moreover, it is highly desirable to match the expansion rate of the room as closely as possible to the expansion rate of the sound leaving the cabinet. In the particular horn described in this invention, the cabinet is placed adjacent to a wall of the room away from a corner of the room in a mid-wall location. The wall W and floor F can be seen in FIG. 3. Depending on the contour of the speaker enclosure, a spacing S of two or three inches of the cabinet from the wall is desirable, and this spacing in effect produces an extension of the horn which is located between the rear panel 14 of the enclosure and the wall and floor, and also between the side panels 16 and 17 of the cabinet and the wall and floor. The sound leaving the mouth of the horn M continues to catenoidally expand around the sides of the cabinet and upwardly toward the top of the cabinet. After the sound leaves the cabinet, this expansion then becomes spherical as it travels outwardly into the room. This spherical expansion approaches more nearly the high rate of expansion required to match the high rate of expansion shown in the vicinity of the point D for the catenoidal curve as illustrated in FIG. 4. If the expansion of the air column does not end in a bell shaped curve which provides the high rate of expansion shown near the point D in FIG. 4, but instead continues to expand slowly as would occur in the vicinity of the point G of the exponential curve E, there tends to be a discontinuity as the sound leaves the cabinet and expands into the room because there is a mismatch between the low rate of expansion along the exponential curve E and the much higher rate of expansion as the sound propagates beyond the point G into the room. This discontinuity resulting from a mismatch not only causes uneven distribution of the sound in the room as well as inefficient performance of the horn at low frequencies, but it also produces further distortion of the sound.

The discussion so far concerning FIG. 4 has worked backwards from the front of the air column in an effort to match the output of the system to the characteristics of the one-quarter spherical expansion in the room. Thus, the discussion has been concerned with the third or bell portion of the loudspeaker expansion rate beginning at the mouth M of the cabinet using its exterior contour. The first portion of the expansion extends from the end of the throat T to the point B, and this first expansion zone is made substantially conical. It could also be exponential because there is relatively little difference in the early stages of these expansion curves. For ease of making the cabinet, the expansion of the air column bounded by the front wall 12 of the horn, the rear wall 21, and two side walls 22 and 23 is made conical so that straight pieces of wood can be conveniently used to make the first portion of the horn located above the line 29, FIG. 1. As can be seen in FIG. 4, the conical rate of expansion is selected so that it approximates the beginning of an exponential curve up to the point B. In early models of the cabinet a plug was inserted inside the conical portion of the horn so as to make this conical portion follow an extension of the exponential curve from B to M, but the plug was later omitted as being unnecessary.

Along the vertical ordinate of the graph of FIG. 4 there are numbers which show the radius in inches of an equivalent horn comprising a volume formed by revolving the curves shown on FIG. 4 about their horizontal abscissa. The point T does not extend all the way to the abscissa because the horn does not begin at a point but instead begins at a larger throat volume bounded by the board **23*a* in FIG. 2, which volume is sufficient to house the loudspeaker 24. In presently manufactured models, the loudspeaker cabinet has a fully enclosed dead air volume behind the loudspeaker 26 which is padded with fiberglass and is made large enough so that it does not unduly limit the excursion of the diaphragm of the loudspeaker 26. This volume extends around on one side to the front panel 12 of the cabinet and includes a zone which can house a tweeter speaker 30, and a small mid-range speaker 32 facing forwardly of the cabinet as shown in FIG. 2**.

The cabinet as actually manufactured has outside dimensions of $32 \times 18 \times 12$ inches and uses two high quality 8 inch speakers. As shown in FIG. 3 the speakers are connected out-of-phase with each other so that the speakers act as oppositely moving pistons when viewed from a point inside the horn in the vicinity of the rear of the loudspeaker 24 and the front of the loudspeaker 26, thus both speakers drive the air volume within the horn simultaneously to either increase or decrease the volume within the horn as a result of the piston action of both speaker cones, and this piston action causes each of the speakers to oppose the motion of the cone of the other speaker. This is very important to good reproduction because the speakers thereby tend to damp each other's cone motions so that, to the extent that they fail to fully couple to the air in the horn, their cones are not simply freed to oscillate back and forth through excessive excursions. In other words, each cone motion becomes limited to such motion as is electrically driven. It is the motion of the cone of a speaker, especially attributable to low frequency drive of large excursion, which produces Doppler errors in the mid-range frequencies radiated from the same speaker, this being a well-known fact. As a result, if it is possible to obtain the required amount of drive for the horn while reducing by some 50% the excursion of the cone in the forward speaker 24, its mid-range frequencies will be greatly improved by the reduction of the Doppler radiation distortion at mid-range frequencies. The rear speaker 26 does not produce an appreciable component of mid-range frequency because it does not radiate directly into the room. These components are lost in fiberglass padding in the fully enclosed portion behind the speaker 26. Thus, using the two speakers, driven out-of-phase and in immediate mutual proximity and alignment, a much cleaner sound is produced in the mid-range frequencies.

Referring now to FIGS. 1 and 3 these views show how to determine actual dimensions based on the selection of the two horn-driving loudspeakers 24 and 26. If nominal 8 inch speakers are selected, then N=8; if 10 inch speakers are selected, then N=10; if 12 inch speakers are selected then N=12, etc.

The cabinet which is illustrated in FIGS. 1 and 2, assuming the selection of 8 inch speakers 24 and 26, would then have exterior dimensions of 4 N=32 inches high, 2.25 N=18 inches wide and 1.5 N=12 inches deep. Internally, the air column starts with a substantially untapered throat section extending on FIG. 4 from A to T over a distance of N=8 inches. Then the first portion of the expansion begins at T extending for another distance of about 1.63 N=13 inches to the point B. Finally, the horn within the cabinet extends over a second expansion portion which is about 1.88 N=15 inches to the point M at the mouth of the cabinet. Other important physical dimensions of the cabinet can be calculated from the various N multipliers shown on the drawings, the thicknesses of all panels and partitions being ¾ inch.

The first expansion portion of the manufactured cabinet where N=8 is conical, and of the formula $$a,\ a+k,\ a+2k,\ a+3k, \ldots$$

(where k=7 square inches, every 2 inches of length; and a=32 square inches)

This section could also be exponential, but the conical expansion comprises an approximation which appears to work just as well.

The second expansion portion of the manufactured cabinet is exponential and of the formula $$ak,\ ak^2,\ ak^3,\ ak^4, \ldots$$

(where at the beginning area of the portion, a=80 square inches, and k=1.0402, every 2 inches of horn length)

With a 15 inch horn length, this second portion provides a mouth area of about 107.5 square inches.

The third expansion portion of the system includes the exterior side and rear surface contours of the cabinet, the adjacent wall and the adjacent floor surfaces of the room. It begins at the mouth of the horn itself and expands along a catenoidal curve of the formula $$r_1;\ r_2=r_1+k;\ r_3=r_2+2k;\ r_4=r_3+3k; \ldots$$

(where $r_1$ is the radius of an equivalent circular cross section, $r_1$=5.85 inches and k=4 inches of horn radius)

This rapid flare contour provides a bell at point D in FIG. 4, where the air column formed by the cabinet joins the one-quarter spherical expansion into the room, and this bell flares so rapidly that it tends to match pretty well the characteristic of the room's spherical expansion to minimize reflections of the type caused by discontinuities.

It is recognized that the production of a horn having the exact expansion characteristics desired, is very difficult and that some degree of minor adjustment of the shape of the horn may be necessary in order to achieve maximum flatness of response over the lower frequency spectrum. Adjustment can be obtained by moving the curved wall 28 up and down slightly within the cabinet to achieve the best position for optimum response characteristics.

The invention is not to be limited to the exact form shown in the drawings, for obviously changes may be made within the scope of the following claims.

I claim:

1. A loudspeaker enclosure system to be placed on the floor of a room in front of a wall at a mid-wall location and spaced outwardly therefrom, comprising:

(a) a cabinet having a front panel, side panels, a rear panel, and a top and a bottom;

(b) a horn in said cabinet having a first smaller air column expansion portion located near the front of the cabinet, the horn expanding down the cabinet from a throat portion located near the top thereof, and the first expansion portion joining a second larger expansion portion curving rearwardly of the cabinet and opening outwardly thereof at a mouth extending through the rear panel;

(c) the first smaller portion of the horn lying against the front panel of the cabinet and having a rear horn wall located intermediate the front and rear cabinet panels;

(d) the second larger air column expansion portion of the horn comprising a front horn wall curving from the front panel of the cabinet rearwardly across the bottom of the cabinet, and said rear horn wall curving downwardly, rearwardly and then upwardly in the cabinet to meet the cabinet rear panel at the mouth, the curvature of the front and rear horn walls providing an exponential expansion rate in the second larger portion of the horn;

(e) driver loudspeaker means in the throat portion of the horn; and (f) the side panels and the rear panel of the cabinet being so proportioned that when the cabinet is placed at a mid-wall location, these panels form with the wall and floor of the room a third air column expansion portion beyond the mouth of the horn and having a catenoidal expansion rate.

2. The loudspeaker enclosure system as claimed in claim 1, wherein said driver loudspeaker means comprises a first loudspeaker in the throat portion directed through the front panel to provide front radiation into the room and back radiation into the horn, and a second loudspeaker in the cabinet behind the throat portion and directed through the rear horn wall to provide front radiation into the horn, the loudspeakers being substantially axially aligned, and being electrically interconnected in out-of-phase relationship.

3. The loudspeaker enclosure system as claimed in claim 2, wherein the spacing between the front panel and the rear horn wall at the throat portion is just great enough to receive the first loudspeaker.

4. The loudspeaker enclosure system as claimed in claim 2, wherein the rear horn wall is canted out of parallel relationship with the front panel of the cabinet, thereby deflecting the axes of the loudspeakers out of perfect alignment.

5. The loudspeaker enclosure system as claimed in claim 4, wherein the first horn portion has a conical expansion rate, and wherein the first portion includes a diagonal wall extending downwardly in the cabinet between the throat and the second expansion portion, the diagonal wall and the throat portion being located with respect to the front panel so that a portion of the front panel is outside of the throat.

6. The loudspeaker enclosure system as claimed in claim 5, wherein said portion of the front panel which is outside of the throat has at least one additional loudspeaker directed therethrough for radiating higher frequencies.

7. A loudspeaker enclosure system including a cabinet having a front panel for facing into the listening area a room and having a horn within the cabinet, the horn having a front horn wall common with said front panel and having a rear horn wall spaced from the front wall, said horn walls defining a throat portion of the horn, and the system having loudspeaker driver means at said throat portion and comprising a first loudspeaker mounted in the front horn wall and having a cone facing into the room, a second loudspeaker mounted in the rear horn wall and having a cone facing toward the first loudspeaker, and the loudspeakers being interconnected for receiving electrical drive in such phase relationship that the cones of the loudspeakers move oppositely, whereby either to simultaneously compress or rarefy the air in the horn throat portion while the first loudspeaker radiates directly into the room.

8. A loudspeaker enclosure system as claimed in claim 7, wherein the loudspeakers are mounted opposite each other in said horn walls with their axes substantially aligned, but with their axes slightly canted with respect to one another, thereby to minimize standing waves in the air space therebetween.

9. A loudspeaker enclosure system as claimed in claim 7, wherein the front panel of the cabinet comprises the front horn wall, and the first loudspeaker is located inside the throat portion and mounted to radiate with front radiation through a hole in the front panel and with back radiation into the horn, and said second loudspeaker is located outside the throat portion and mounted to radiate with front radiation through a hole in the rear horn wall into the throat portion.

10. A loudspeaker enclosure system as claimed in claim 9, wherein the throat is only deep enough as measured between its front and back horn walls to receive the first loudspeaker, and wherein the cabinet is fully enclosed behind the rear horn wall and about the second loudspeaker.

* * * * *